US012312738B2

(12) United States Patent
Nishigawa et al.

(10) Patent No.: US 12,312,738 B2
(45) Date of Patent: May 27, 2025

(54) TREATMENT AGENT FOR ELASTIC FIBERS, AND ELASTIC FIBERS

(71) Applicant: TAKEMOTO OIL & FAT CO., LTD., Gamagori (JP)

(72) Inventors: Takeshi Nishigawa, Gamagori (JP); Jun Ito, Gamagori (JP); Kohei Oda, Gamagori (JP)

(73) Assignee: Takemoto Oil & Fat Co., Ltd., Gamagori (JP)

( * ) Notice: Subject to any disclaimer, the term of this patent is extended or adjusted under 35 U.S.C. 154(b) by 0 days.

(21) Appl. No.: 18/712,380

(22) PCT Filed: Nov. 21, 2022

(86) PCT No.: PCT/JP2022/043020
§ 371 (c)(1),
(2) Date: May 22, 2024

(87) PCT Pub. No.: WO2023/095746
PCT Pub. Date: Jun. 1, 2023

(65) Prior Publication Data

US 2024/0328072 A1 Oct. 3, 2024

(30) Foreign Application Priority Data

Nov. 29, 2021 (JP) ..... 2021-193223

(51) Int. Cl.
*D06M 13/17* (2006.01)
*D06M 15/53* (2006.01)
*D06M 15/647* (2006.01)

(52) U.S. Cl.
CPC ..... *D06M 13/17* (2013.01); *D06M 15/53* (2013.01); *D06M 15/647* (2013.01)

(58) Field of Classification Search
CPC ..... D06M 13/17; D06M 15/53; D06M 15/647
See application file for complete search history.

(56) References Cited

U.S. PATENT DOCUMENTS

2020/0172833 A1* 6/2020 Morikawa ..... D06M 13/256

FOREIGN PATENT DOCUMENTS

| | | | |
|---|---|---|---|
| JP | H09-268477 | A | 10/1997 |
| JP | H09-296377 | A | 11/1997 |
| JP | 2003-147675 | A | 5/2003 |
| JP | 2007-100291 | A | 4/2007 |
| JP | 2007-246865 | A | 9/2007 |
| JP | 2015-206151 | A | 11/2015 |
| JP | 2017-082380 | A | 5/2017 |
| JP | 2019-123953 | A | 7/2019 |
| KR | 20070071748 | A | 7/2007 |
| TW | 202104429 | A | 2/2021 |

OTHER PUBLICATIONS

Japanese Decision to Grant a Patent dated Feb. 21, 2022, in connection with Japanese Application No. 2021-193223, and English translation thereof.
International Search Report dated Feb. 14, 2023, in connection with International Application No. PCT/JP2022/043020, and English translation thereof.

* cited by examiner

*Primary Examiner* — Andrew J. Oyer
(74) *Attorney, Agent, or Firm* — Wolf, Greenfield & Sacks, P.C.

(57) ABSTRACT

Disclosed is an elastic fiber treatment agent that contains a polyether-modified silicone, a smoothing agent other than the polyether-modified silicone, and water. The polyether-modified silicone is contained in the elastic fiber treatment agent at a content of 0.01% by mass or more and 10% by mass or less. The polyether-modified silicone has a hydrophilic-lipophilic balance (HLB) of 1 or more and 7 or less.

6 Claims, No Drawings

TREATMENT AGENT FOR ELASTIC FIBERS, AND ELASTIC FIBERS

CROSS REFERENCE TO RELATED APPLICATIONS

This Application is a national stage filing under 35 U.S.C. 371 of International Patent Application Serial No PCT/JP2022/043020, filed Nov. 21, 2022, which claims priority to Japanese application number 2021-193223, filed Nov. 29, 2021. The entire contents of these applications are incorporated herein by reference in their entirety.

TECHNICAL FIELD

The present invention relates to an elastic fiber treatment agent containing a specific polyether-modified silicone, and to an elastic fiber to which the elastic fiber treatment agent adheres.

BACKGROUND ART

Elastic fibers, such as polyurethane elastic fibers, have stronger adhesiveness between the fibers than other synthetic fibers. Consequently, there is a problem in that when elastic fibers are spun, wound into a package, then drawn out from the package to be subject to a processing step, it is difficult to unwind the elastic fibers stably from the package. To address this, an elastic fiber treatment agent containing a smoothing agent such as hydrocarbon oil may be used to improve the smoothness of elastic fibers.

Elastic fiber treatment agents as disclosed in Patent Documents 1 to 4 are already known. Patent Document 1 discloses an elastic fiber treatment agent containing a base component and 0.01% to 30% by mass of a nonionic surfactant having an HLB of 3 to 15. Patent Document 2 discloses an elastic fiber treatment agent containing a base component, 0.1% to 20% by mass of water, a lower alcohol with a hydrocarbon group having 1 to 15 carbon atoms, or an alkylene oxide adduct of the lower alcohol, and 0.1% to 30% by mass of an emulsifier. Patent Document 3 discloses an elastic fiber oil agent containing a polyoxyalkylene ether-modified polysiloxane having a polyoxyethylene skeleton content of 20% to 80% by mass in the molecule. Patent Document 4 discloses an elastic fiber oil agent containing diorganopolysiloxane, mineral oil, and modified silicone having a polyoxyalkylene group.

CITATIONS LIST

Patent Literature

Patent Document 1: Japanese Laid-Open Patent Publication No. 2007-100291

Patent Document 2: Japanese Laid-Open Patent Publication No. 2003-147675

Patent Document 3: Japanese Laid-Open Patent Publication No. H09-268477

Patent Document 4: Japanese Laid-Open Patent Publication No. H09-296377

SUMMARY OF INVENTION

Technical Problems

However, it has been required to further achieve both improvement in the electrical characteristics of the elastic fiber and improvement in the stability of the elastic fiber treatment agent.

Solutions to Problems

As a result of research to solve the above problems, the inventors of the present application have found that an elastic fiber treatment agent is preferable in which a polyether-modified silicone having a predetermined HLB, a smoothing agent other than the polyether-modified silicone, and water are blended.

In order to solve the above problems and in accordance with an aspect of the present invention, an elastic fiber treatment agent contains a polyether-modified silicone, a smoothing agent other than the polyether-modified silicone, and water. The polyether-modified silicone is contained in the elastic fiber treatment agent at a content of 0.01% by mass or more and 10% by mass or less. The polyether-modified silicone has an HLB of 1 or more and 7 or less.

In the elastic fiber treatment agent, the HLB of the polyether-modified silicone may be 1 or more and 6 or less.

The content of the polyether-modified silicone in the elastic fiber treatment agent may be 0.01% by mass or more and 2.5% by mass or less.

The water may be contained in the elastic fiber treatment agent at a content of 0.01% by mass or more and 1.0% by mass or less.

The content of the water in the elastic fiber treatment agent may be 0.01% by mass or more and 0.1% by mass or less.

The elastic fiber treatment agent may further contain an allylated polyether, and the content of the allylated polyether in the elastic fiber treatment agent may be 0.001% by mass or more and 0.2% by mass or less.

In order to solve the above problems and in accordance with another aspect of the present invention, an elastic fiber has the elastic fiber treatment agent adhered thereto.

Advantageous Effects of Invention

According to the present invention, it is possible to achieve both improvement in electrical characteristics of the elastic fiber and improvement in the stability of the elastic fiber treatment agent.

DESCRIPTION OF EMBODIMENTS

First Embodiment

A first embodiment of an elastic fiber treatment agent (hereinafter, referred to as treatment agent) according to the present invention will now be described. The treatment agent of the present embodiment contains a polyether-modified silicone, a smoothing agent other than the polyether-modified silicone, and water, and may further contain an allylated polyether.

(Polyether-Modified Silicone)

The polyether-modified silicone used in the treatment agent of the present embodiment has a hydrophilic-lipophilic balance (HLB) of 1 or more and 7 or less. The use of this polyether-modified silicone can improve the stability of the treatment agent containing water.

The polyether-modified silicone can be any of known polyether-modified silicones. In order to satisfy the requirement that the HLB of the polyether-modified silicone is in the range of 1 or more and 7 or less, a polyether-modified silicone having an oxyalkylene chain is used. Specific examples of the alkylene oxide as a raw material of the oxyalkylene chain include ethylene oxide and propylene oxide. The alkylene oxide may be used singly, or in combination of two types thereof. When two types of alkylene oxides are used, the addition form thereof may be any of block addition, random addition, and a combination of block addition and random addition, and is not particularly limited.

Examples of the polyether-modified silicone include ABn type polyether-modified silicone, side chain polyether-modified silicone, both terminal polyether-modified silicone, alkyl polyether-modified silicone in which both a polyether group and an alkyl group are introduced to a side chain or a terminal, side chain polyether-modified silicone having a polyether chain terminal portion capped with an aliphatic compound or a fatty acid compound, and both terminal polyether-modified silicone having a polyether chain terminal portion capped with an aliphatic compound or a fatty acid compound.

The polyether-modified silicone may be used singly, or in combination of two or more types thereof.

The HLB of the polyether-modified silicone is 1 or more and 7 or less, and preferably 1 or more and 6 or less. Any selected range combining the above upper and lower limits is also permissible. When the HLB of the polyether-modified silicone is set within such a range, the stability of the treatment agent can be improved.

The HLB value of a polyether-modified silicone in which a polyether group containing an oxyalkylene group having 2 to 3 carbon atoms is introduced into a side chain of a silicone chain is determined by the following formula. In the formula, "(EO)" represents an ethyleneoxy group, "(PO)" represents a propyleneoxy group (the same applies hereinafter), "% by mass of (EO)" represents the proportion of the ethyleneoxy group in the polyether-modified silicone molecule, and "% by mass of (PO)" represents the proportion of the propyleneoxy group in the polyether-modified silicone molecule.

$$HLB = [\%\text{ by mass of }(EO) + \%\text{ by mass of }(PO)] \div 5$$

When a plurality of types of polyether-modified silicones are used, the HLB value is determined by the weighted average of HLB values of the polyether-modified silicones based on the mass ratio thereof. For example, when 90 parts by mass of a polyether-modified silicone having an HLB of 1 and 10 parts by mass of a polyether-modified silicone having an HLB of 6 are used, the value of HLB is 1.5.

The lower limit of the kinematic viscosity of the polyether-modified silicone at 25° C. is not particularly limited, but is preferably 100 $mm^2/s$ or more, and more preferably 300 $mm^2/s$ or more. The upper limit of the kinematic viscosity of the polyether-modified silicone at 25° C. is not particularly limited, but is preferably 7,000 $mm^2/s$ or less, and more preferably 5,000 $mm^2/s$ or less. Any selected range combining the above upper and lower limits is also permissible. By setting the kinematic viscosity within such a range, the stability of the treatment agent can be further improved. The kinematic viscosity when a plurality of types of polyether-modified silicones are used is an actual measured value of a mixture of a plurality of polyether-modified silicones to be used.

The lower limit of the content of the polyether-modified silicone in the treatment agent is 0.01% by mass or more. When the content is 0.01% by mass or more, the stability of the treatment agent can be improved. The upper limit of the content of the polyether-modified silicone is 10% by mass or less, and preferably 2.5% by mass or less. When the content is 10% by mass or less, the stability of the treatment agent can be further improved. Any selected range combining the above upper and lower limits is also permissible.

(Smoothing Agent)

The smoothing agent is blended in the treatment agent as a base component, and functions to impart smoothness to the elastic fiber. Examples of the smoothing agent include mineral oils, silicone oils, ester oil, and polyolefins.

Examples of the mineral oil include aromatic hydrocarbons, paraffin hydrocarbons, and naphthene hydrocarbons. More specific examples thereof include spindle oil and liquid paraffin. Commercially available mineral oils, characterized by their viscosity among other properties, can be suitably selected for use.

Specific examples of the silicone oil include dimethyl silicone, phenyl-modified silicone, amino-modified silicone, amide-modified silicone, polyether-modified silicones other than the above-described polyether-modified silicones, aminopolyether-modified silicone, alkyl-modified silicone, alkylaralkyl-modified silicone, alkylpolyether-modified silicone, ester-modified silicone, epoxy-modified silicone, carbinol-modified silicone, mercapto-modified silicone, and polyoxyalkylene-modified silicones other than the above-described polyether-modified silicones. Commercially available silicone oils, characterized by their kinematic viscosity among other properties can be suitably selected for use. The kinematic viscosity is appropriately set, but the kinematic viscosity at 25° C. is preferably 2 to 100 cst ($mm^2/s$). The kinematic viscosity at 25° C. is measured in accordance with JIS Z 8803.

The ester oil is not particularly limited, and examples thereof include an ester oil produced from a fatty acid and an alcohol. The ester oil may be produced from, for example, a fatty acid having an odd number or an even number of hydrocarbon groups described later and an alcohol.

The fatty acid used as a raw material for the ester oil is not particularly limited by factors such as the number of carbon atoms, the presence or absence of branching, or valence, and may be, for example, a higher fatty acid, a fatty acid having a cyclo ring, or a fatty acid having an aromatic ring. The alcohol used as a raw material for the ester oil is not particularly limited by factors such as the number of carbon atoms, the presence or absence of branching, or valence, and may be, for example, a higher alcohol, an alcohol having a cyclo ring, or an alcohol having an aromatic ring.

Specific examples of the ester oil include (1) an ester compound of an aliphatic monoalcohol and an aliphatic monocarboxylic acid, such as octyl palmitate, oleyl laurate, oleyl oleate, isotridecyl stearate, and isotetracosyl oleate; (2) an ester compound of an aliphatic polyhydric alcohol and an aliphatic monocarboxylic acid, such as 1,6-hexanediol didecanoate, glycerin trioleate, trimethylolpropane trilaurate, and pentaerythritol tetraoctanate; (3) an ester compound of an aliphatic monoalcohol and an aliphatic polycarboxylic acid, such as dioleyl azelate, thiodipropionic acid dioleyl, thiodipropionic acid diisocetyl, and thiodipropionic acid diisostearyl; (4) an ester compound of an aromatic monoalcohol and an aliphatic monocarboxylic acid, such as benzyl oleate and benzyl laurate; (5) a complete ester compound of an aromatic polyhydric alcohol and an aliphatic monocarboxylic acid, such as bisphenol A dilaurate; (6) a complete ester compound of an aliphatic monoalcohol and an aromatic polycarboxylic acid, such as bis(2-ethylhexyl) phthalate, diisostearyl isophthalate, and trioctyl trimellitate; and (7) a natural oil and fat, such as coconut oil, rapeseed oil, sunflower oil, soybean oil, castor oil, sesame oil, fish oil, and beef tallow.

As the polyolefin, a poly-α-olefin used as a smoothing component is available. Specific examples of the polyolefin include a poly-α-olefin obtained by polymerizing monomers such as 1-butene, 1-hexene, and 1-decene. Commercially available poly-α-olefin products can be suitably selected for use.

The smoothing agent may be used singly, or in combination of two or more types thereof.

(Water)

Water is blended to improve the electrical characteristics of the elastic fiber to which the treatment agent is applied. The lower limit of the content of water in the treatment agent is preferably 0.01% by mass or more. When the content is 0.01% by mass or more, the electrical characteristics can be further improved. The upper limit of the content of water is preferably 1.0% by mass or less, and more preferably 0.1% by mass or less. When the content is 1.0% by mass or less, the stability of the treatment agent can be further improved. Any selected range combining the above upper and lower limits is also permissible.

(Allylated Polyether)

The treatment agent of the present embodiment may contain an allylated polyether. The allylated polyether can further improve the stability of the treatment agent.

The allylated polyether is a polyether compound having an allyl group, and examples thereof include a compound in which an alkylene oxide is added to allyl alcohol (2-propen-1-ol), and a compound having a terminal capped with an aliphatic compound or the like. Specific examples of the alkylene oxide include ethylene oxide, propylene oxide, and butylene oxide.

Specific examples of the compound in which an alkylene oxide is added to allyl alcohol include a compound in which ethylene oxide is added to allyl alcohol, a compound in which propylene oxide is added to allyl alcohol, a compound in which ethylene oxide and propylene oxide are randomly added to allyl alcohol, and a compound in which ethylene oxide and propylene oxide are added in blocks or randomly to allyl alcohol.

Specific examples of the compound having a terminal capped with an aliphatic compound or the like include a methoxy compound in which an alkylene oxide is added to allyl alcohol, an ethoxylated compound in which an alkylene oxide is added to allyl alcohol, a butoxy compound in which an alkylene oxide is added to allyl alcohol, an isobutoxy compound in which an alkylene oxide is added to allyl alcohol, and an acetylated product in which an alkylene oxide is added to allyl alcohol.

The allylated polyether is preferably an adduct of at least one alkylene oxide selected from ethylene oxide and propylene oxide.

The molecular weight of the allylated polyether is not particularly limited, but those having a number average molecular weight of 200 or more and 5,000 or less are preferable. The number average molecular weight of the allylated polyether is determined as a value obtained by performing measurement using gel permeation chromatography (GPC) and expressing the measured value in terms of polystyrene.

The allylated polyether may be used singly, or in combination of two or more types thereof.

The lower limit of the content of the allylated polyether in the treatment agent is preferably 0.001% by mass or more. When the content is 0.001% by mass or more, the stability of the treatment agent can be further improved. The upper limit of the content of the allylated polyether is preferably 0.2% by mass or less. When the content is 0.2% by mass or less, the frictional characteristics of the elastic fiber can be improved to which the treatment agent is applied. Any selected range combining the above upper and lower limits is also permissible.

Second Embodiment

Next, a second embodiment of an elastic fiber according to the present invention will be described. The elastic fiber of the present embodiment has the treatment agent of the first embodiment adhered thereto. The adhesion amount of the treatment agent (not containing a solvent) of the first embodiment to the elastic fiber is not particularly limited, but it is preferable that the treatment agent adheres to the elastic fiber in an amount of 0.1% by mass or more and 10% by mass or less from the viewpoint of further improving the effects of the present invention.

Specific examples of the elastic fiber include, but are not particularly limited to, a polyester elastic fiber, a polyamide elastic fiber, a polyolefin elastic fiber, and a polyurethane elastic fiber. Among them, a polyurethane elastic fiber is preferable because the expression of the effects of the present invention can be further enhanced.

The method for producing an elastic fiber of the present embodiment includes lubricating the elastic fiber with the treatment agent of the first embodiment. For lubricating with the treatment agent, it is preferable to use the neat lubrication method, which involves applying the treatment agent, without diluting, to the elastic fiber during the process of spinning the elastic fiber. The adhesion method can be a known method such as a roller lubrication method, a guide lubrication method, or a spray lubrication method. A lubrication roller is typically located between a spinneret and a winding traverse, and can be integral to the production method of the present embodiment. Among these methods, using a lubrication roller located between stretching rollers to apply the treatment agent of the first embodiment to an elastic fiber, for example, to a polyurethane elastic fiber, is preferable because the effects are remarkably exhibited.

The method for producing the elastic fiber to be applied to the present embodiment is not particularly limited, and the elastic fiber can be produced by a known method. Examples thereof include a wet spinning method, a melt spinning method, and a dry spinning method. Among them, the dry spinning method is preferable from the viewpoint of excellent quality and production efficiency of the elastic fiber.

Effects of the treatment agent and the elastic fiber of the present embodiment will be described.

(1) The treatment agent of the present embodiment contains 0.01% by mass or more and 10% by mass or less of a polyether-modified silicone having an HLB of 1 or more and 7 or less, a smoothing agent other than the polyether-modified silicone, and water. Therefore, it is possible to achieve both improvement in the electrical characteristics of the elastic fiber to which the treatment agent is applied and improvement in the stability of the treatment agent containing water.

The above embodiments may be modified as follows. The above embodiments and the following modifications can be implemented in combination with each other within a technically consistent range.

The treatment agent of the above embodiments may further contain a component commonly used in treatment agents to maintain the quality of the treatment agents, such as a stabilizer, an antistatic agent, a binder, an antioxidant, or an ultraviolet absorber, provided that the effects of the present invention are not impaired.

EXAMPLES

Examples will now be given below to describe the features and effects of the present invention more specifically, but the present invention is not limited to these examples. In the following description of working examples and comparative examples, part means part by mass, and % means % by mass.

Experimental Part 1 (Preparation of Treatment Agent)

The treatment agents used in Examples and Comparative Examples were prepared by the following preparation method using the components shown in Table 1. Two parts (%) of a polyether-modified silicone (PE-1) having an HLB of 1, 0.08 parts (%) of water, 0.01 parts (%) of polyoxyalkylene monoallyl ether (EO/PO molar ratio: 100/0) (ALPE-1) as an allylated polyether, 60 parts (%) of dimethyl silicone (kinematic viscosity: 10 $mm^2/s$ (25° C.)) (A-2) as a smoothing agent, and 37.91 parts (%) of a mineral oil (viscosity: 40 Redwood seconds (40° C.)) (A-4) were well mixed and homogenized to prepare a treatment agent of Example 1.

In Examples 2 to 22 and Comparative Examples 1 to 6, polyether-modified silicone, water, allylated polyether, and a smoothing agent were mixed in the same manner as in Example 1 at the ratios shown in Table 1 to prepare treatment agents.

The type and content of the polyether-modified silicone, the content of water, the type and content of the allylated polyether, and the type and content of the smoothing agent in the treatment agent of each example are shown in the "polyether-modified silicone" column, the "water" column, the "allylated polyether" column, and the "smoothing agent" column of Table 1, respectively.

TABLE 1

| | Polyether-modified silicone | | Water | Allylated polyether | | Smoothing agent | | | | | | FM | Appearance of treatment agent | OR gel | | Leakage |
|---|---|---|---|---|---|---|---|---|---|---|---|---|---|---|---|---|
| Section | Type | Content (%) | Content (%) | Type | Content (%) | Type | Content (%) | Type | Content (%) | Type | Content (%) | friction | | 1 week | 3 days | resistance |
| Example 1 | PE-1 | 2.0 | 0.08 | ALPE-1 | 0.01 | A-2 | 60.0 | A-4 | 37.91 | | | ◎ | ◎ | ◎ | ◎ | ◎ |
| Example 2 | PE-1 | 0.3 | 0.05 | ALPE-3 | 0.005 | A-2 | 44.645 | A-5 | 55.0 | | | ◎ | ◎ | ◎ | ◎ | ◎ |
| Example 3 | PE-1 | 1.5 | 0.02 | ALPE-2 | 0.001 | A-1 | 3.479 | A-2 | 40.0 | A-5 | 55.0 | ◎ | ◎ | ◎ | ◎ | ◎ |
| Example 4 | PE-2 | 0.5 | 0.05 | ALPE-2 | 0.1 | A-2 | 55.0 | A-4 | 10.0 | A-5 | 34.35 | ◎ | ◎ | ◎ | ◎ | ◎ |
| Example 5 | PE-2 | 1.0 | 0.01 | ALPE-4 | 0.01 | A-2 | 45.0 | A-4 | 30.0 | A-5 | 23.98 | ◎ | ◎ | ◎ | ◎ | ◎ |
| Example 6 | PE-3 | 0.1 | 0.01 | ALPE-2 | 0.008 | A-2 | 54.882 | A-3 | 5.0 | A-5 | 40.0 | ◎ | ◎ | ◎ | ◎ | ◎ |
| Example 7 | PE-3 | 2.3 | 0.10 | ALPE-1 | 0.08 | A-2 | 40.0 | A-5 | 57.52 | | | ◎ | ◎ | ◎ | ◎ | ◎ |
| Example 8 | PE-4 | 1.0 | 0.03 | ALPE-1 | 0.15 | A-2 | 38.82 | A-4 | 10.0 | A-5 | 50.0 | ◎ | ◎ | ◎ | ◎ | ◎ |
| Example 9 | PE-4 | 2.5 | 0.08 | ALPE-2 | 0.05 | A-2 | 32.37 | A-3 | 10.0 | A-4 | 55.0 | ◎ | ◎ | ◎ | ◎ | ◎ |
| Example 10 | PE-4 | 0.8 | 0.05 | ALPE-4 | 0.003 | A-2 | 39.147 | A-5 | 60.0 | | | ◎ | ◎ | ◎ | ◎ | ◎ |
| Example 11 | PE-5 | 0.01 | 0.02 | ALPE-2 | 0.2 | A-1 | 25.0 | A-3 | 15.0 | A-5 | 59.77 | ◎ | ◎ | ◎ | ◎ | ◎ |
| Example 12 | PE-5 | 1.0 | 0.03 | ALPE-2 | 0.1 | A-2 | 38.87 | A-5 | 60.0 | | | ◎ | ◎ | ◎ | ◎ | ◎ |
| Example 13 | PE-6 | 0.1 | 0.03 | ALPE-1 | 0.005 | A-1 | 5.0 | A-2 | 40.0 | A-4 | 54.865 | ◎ | ◎ | ◎ | ◎ | ◎ |
| Example 14 | PE-6 | 2.0 | 0.10 | ALPE-2 | 0.005 | A-2 | 60.0 | A-4 | 37.895 | | | ◎ | ◎ | ◎ | ◎ | ◎ |
| Example 15 | PE-4 | 1.0 | 0.08 | — | — | A-2 | 35.0 | A-5 | 63.92 | | | ◎ | ◎ | ○ | ◎ | ◎ |
| Example 16 | PE-2 | 0.5 | 0.10 | ALPE-2 | 0.50 | A-2 | 55.0 | A-3 | 5.0 | A-4 | 38.9 | ○ | ◎ | ◎ | ◎ | ◎ |
| Example 17 | PE-2 | 1.0 | 0.80 | ALPE-1 | 0.005 | A-2 | 75.0 | A-5 | 23.195 | | | ◎ | ◎ | ○ | ◎ | ◎ |
| Example 18 | PE-6 | 1.0 | 1.20 | ALPE-4 | 0.005 | A-2 | 35.0 | A-4 | 25.0 | A-5 | 37.795 | ◎ | ◎ | ○ | ○ | ◎ |
| Example 19 | PE-1 | 0.5 | 0.005 | ALPE-1 | 0.003 | A-2 | 60.0 | A-5 | 39.492 | | | ◎ | ◎ | ◎ | ◎ | ○ |
| Example 20 | PE-5 | 5.0 | 0.05 | ALPE-3 | 0.1 | A-2 | 50.0 | A-5 | 44.85 | | | ◎ | ◎ | ○ | ◎ | ◎ |
| Example 21 | PE-7 | 1.0 | 0.03 | ALPE-2 | 0.05 | A-1 | 3.0 | A-2 | 35.0 | A-5 | 60.92 | ◎ | ◎ | ○ | ◎ | ◎ |
| Example 22 | PE-8 | 0.5 | 0.80 | ALPE-2 | 0.01 | A-1 | 30.0 | A-3 | 15.0 | A-5 | 53.69 | ◎ | ◎ | ○ | ○ | ◎ |
| Comparative Example 1 | rPE-1 | 1.0 | 0.30 | ALPE-1 | 0.02 | A-2 | 40.0 | A-5 | 58.68 | | | ○ | ○ | X | ○ | ◎ |
| Comparative Example 2 | rPE-2 | 2.0 | 0.10 | ALPE-3 | 0.01 | A-2 | 35.0 | A-4 | 12.89 | A-5 | 50.0 | ○ | ○ | X | X | ◎ |
| Comparative Example 3 | rPE-3 | 0.5 | 0.20 | ALPE-1 | 0.05 | A-1 | 25.0 | A-2 | 40.0 | A-5 | 34.25 | — | X | — | — | — |
| Comparative Example 4 | — | — | 0.05 | ALPE-3 | 0.005 | A-2 | 49.945 | A-3 | 20.0 | A-4 | 30.0 | X | ◎ | X | ○ | ○ |
| Comparative Example 5 | PE-5 | 0.5 | — | ALPE-1 | 0.005 | A-2 | 44.495 | A-5 | 55.0 | | | ○ | ◎ | ◎ | ◎ | X |
| Comparative Example 6 | rPE-4 | 3.0 | 0.1 | ALPE-2 | 0.2 | A-2 | 40.0 | A-4 | 40.0 | A-5 | 16.7 | — | X | — | — | — |

Details of the polyether-modified silicone, the allylated polyether, and the smoothing agent described in Table 1 are as follows.

(Polyether-Modified Silicone)

PE-1: polyether-modified silicone-1 (HLB=1) (kinematic viscosity 1,000 $mm^2/s$ (25° C.))

PE-2: polyether-modified silicone-2 (HLB=2) (kinematic viscosity 1,200 $mm^2/s$ (25° C.))

PE-3: polyether-modified silicone-3 (HLB=4) (kinematic viscosity 3,400 $mm^2/s$ (25° C.))

PE-4: polyether-modified silicone-4 (HLB=5) (kinematic viscosity 2,800 $mm^2/s$ (25° C.))

PE-5: polyether-modified silicone-5 (HLB=5) (kinematic viscosity 3,600 $mm^2/s$ (25° C.))

PE-6: polyether-modified silicone-6 (HLB=6) (kinematic viscosity 2,900 $mm^2/s$ (25° C.))

PE-7: polyether-modified silicone-7 (HLB=7) (kinematic viscosity 1,500 $mm^2/s$ (25° C.))

PE-8: polyether-modified silicone-8 (HLB=7) (kinematic viscosity 7,000 $mm^2/s$ (25° C.))

rPE-1: polyether-modified silicone-9 (HLB=8) (kinematic viscosity 1,200 $mm^2/s$ (25° C.))

rPE-2: polyether-modified silicone-10 (HLB=10) (kinematic viscosity 300 $mm^2/s$ (25° C.))

rPE-3: polyether-modified silicone-11 (HLB=16) (kinematic viscosity 200 $mm^2/s$ (25° C.))

rPE-4: polyoxyethylene alkyl ether (HLB=12) (kinematic viscosity 30 $mm^2/s$ (25° C.))

(Allylated Polyether)

ALPE-1: polyoxyalkylene monoallyl ether (EO/PO molar ratio=100/0) (number average molecular weight: 1,500)

ALPE-2: polyoxyalkylene monoallyl ether (EO/PO molar ratio=100/0) (number average molecular weight: 450)

ALPE-3: polyoxyalkylene monoallyl ether (EO/PO molar ratio=75/25 (random)) (number average molecular weight: 750)

ALPE-4: polyoxyalkylene monoallyl ether (EO/PO molar ratio=0/100) (number average molecular weight: 1,500)

(Smoothing Agent)

A-1: dimethyl silicone (kinematic viscosity 5 $mm^2/s$ (25° C.))

A-2: dimethyl silicone (kinematic viscosity 10 $mm^2/s$ (25° C.))

A-3: dimethyl silicone (kinematic viscosity 20 $mm^2/s$ (25° C.))

A-4: mineral oil (viscosity: 40 Redwood seconds (40° C.))

A-5: mineral oil (viscosity: 80 Redwood seconds (40° C.))

Experimental Part 2 (Production of Elastic Fiber)

A prepolymer obtained from polytetramethylene glycol having a molecular weight of 1,000 and diphenylmethane diisocyanate was subjected to a chain extension reaction with ethylenediamine in a dimethylformamide solution to obtain a spinning dope having a concentration of 30%. This spinning dope was dry-spun from a spinneret in a heated gas flow. Then, the dry-spun polyurethane elastic fiber was neat-lubricated with a treatment agent by the roller oiling method from a lubrication roller located between the stretching rollers prior to winding.

The elastic fiber to which the treatment agent had been applied via roller lubrication as described above was wound, using a surface-drive winding machine, onto a cylindrical paper tube with a length of 58 mm at a winding speed of 600 m/min using a traverse guide to achieve a winding width of 38 mm to obtain 500 g of a package of 40 denier dry-spun polyurethane elastic fiber. The amount of the treatment agent adhered was adjusted to 5% by controlling the rotation speed of the lubrication roller.

Using the treatment agents or packages thus obtained, the smoothness of the elastic fiber, the stability of the treatment agent, and the electrical characteristics of the elastic fiber were evaluated as described below.

Experimental Part 3 (Evaluation of Treatment Agent and Elastic Fiber)

Evaluation of Smoothness of Elastic Fiber by Fiber to Metal Friction (FM Friction)

An evaluation test of FM friction was carried out using the yarn package obtained in Experimental Part 2, along with one or three knitting needles. When one knitting needle is used, it is disposed between two free rollers, and the polyurethane elastic fiber drawn out from the yarn package is threaded in sequence around the free roller, the knitting needle, and then the free roller. The polyurethane elastic fiber is positioned such that the contact angle at the knitting needle is 90 degrees. When three knitting needles are used, each of the two free rollers used in the single knitting needle setup is replaced with an additional knitting needle.

In evaluating the FM friction, an initial evaluation test with three knitting needles was carried out by threading the yarn around the three knitting needles and running it for 3 minutes, feeding at 100 m/min and winding at 300 m/min. If yarn breakage occurred within 3 minutes, a subsequent evaluation test with one knitting needle was carried out. In the single knitting needle setup, the yarn was run for 3 minutes in the same manner as in the three knitting needles setup. The evaluation results are shown in the "FM friction" column of Table 1 according to the following criteria.

Evaluation Criteria for FM Friction

◎ (good): There was no yarn breakage in the evaluation test with three knitting needles.

○ (acceptable): Yarn breakage occurred in the evaluation test with three knitting needles, but yarn breakage did not occur in the evaluation test with one knitting needle.

x (unacceptable): Yarn breakage occurred in the evaluation test with one knitting needle.

—: Droplets were generated during preparation of the treatment agent and measurement was impossible.

Evaluation of Stability of Treatment Agent by Appearance

For the treatment agent of each example obtained in Experimental Part 1, the appearance at the time of blending (that is, immediately after preparation) was visually evaluated according to the following criteria. The evaluation results are shown in the "appearance of treatment agent" column of Table 1.

Evaluation Criteria for Appearance of Treatment Agent

◎ (good): The appearance of the treatment agent was a transparent liquid.

○ (acceptable): The appearance of the treatment agent was cloudy or milky.

x (unacceptable): There was a droplet in the treatment agent.

Evaluation of Stability of Treatment Agent by Gel (OR Gel) on Surface of Oiling Roller The stability of the treatment agent of each example obtained in Experimental Part 1 was evaluated by a measurement method using an OR gel measuring apparatus. The OR gel measuring apparatus includes an oiling roller which is a rotating drum having a diameter of 70 mm× a roller width of 20 mm and capable of rotating on a horizontal axis at a predetermined rotation speed, and a circular dish-shaped oiling tray having a depth of about 20 mm. The oiling roller and the oiling tray are disposed such that when a predetermined amount of a treatment agent is poured into the oiling tray, a peripheral surface of the oiling roller is immersed in the treatment agent at a predetermined depth.

First, the oiling tray is filled with the treatment agent of each example, and the oiling roller is set to a height where its peripheral surface is immersed at a depth of 10 mm. The oiling roller is rotated at a speed of five rotations per minute. After 3 days and again after 1 week from the start of the rotation, the appearance of the oiling tray and the presence or absence of gel on the surface of the oiling roller were visually confirmed and evaluated according to the following criteria. The evaluation results are shown in the "OR gel" column of Table 1.

Evaluation Criteria for OR Gel

- ◎ (good): There was no cloudiness of the treatment agent in the oiling tray, and there was no gel on the surface of the oiling roller.
- ○ (acceptable): There was cloudiness of the treatment agent in the oiling tray, and there was no gel on the surface of the oiling roller.
- x (unacceptable): There was cloudiness of the treatment agent in the oiling tray, and there was gel on the surface of the oiling roller.
- —: Droplets were generated during preparation of the treatment agent and measurement was impossible.

Evaluation of Electrical Characteristics of Elastic Fiber by Leakage Resistance

In Experimental Part 2, the electric resistance of 5 g of the elastic fiber immediately after application of the treatment agent via roller lubrication was measured at 25° C. and 40% RH using an electric resistance measuring device (SM-5E type, manufactured by Toa Electronics, Ltd.). The measured values were evaluated according to the following criteria. The evaluation results are shown in the "leakage resistance" column of Table 1.

Evaluation Criteria for Leakage Resistance

- ◎ (good): the electric resistance value was less than $1.0\times10^{9}\Omega$.
- ○ (acceptable): The electric resistance value was $1.0\times10^{9}\Omega$ or more and less than $1.0\times10^{10}$.
- x (unacceptable): The electric resistance value was $1.0\times10^{10}\Omega$ or more.
- —: Droplets were generated during preparation of the treatment agent and measurement was impossible.

As is apparent from the evaluation results of Examples compared to Comparative Examples in Table 1, the treatment agent of the present invention succeeds in improving the electrical characteristics and smoothness of the elastic fiber to which the treating agent is applied. In addition, the stability of the treatment agent can be improved.

The invention claimed is:

1. An elastic fiber treatment agent comprising:

a polyether-modified silicone;

a smoothing agent other than the polyether-modified silicone, the smoothing agent including mineral oil or dimethyl silicone; and water, wherein the polyether-modified silicone is contained in the elastic fiber treatment agent at a content of 0.01% by mass or more and 10% by mass or less, and the polyether-modified silicone has an HLB of 1 or more and 7 or less;

wherein the water is contained in the elastic fiber treatment agent at a content of 0.01% by mass or more and 1.0% by mass or less.

2. The elastic fiber treatment agent according to claim 1, wherein the HLB of the polyether-modified silicone is 1 or more and 6 or less.

3. The elastic fiber treatment agent according to claim 1, wherein the content of the polyether-modified silicone in the elastic fiber treatment agent is 0.01% by mass or more and 2.5% by mass or less.

4. The elastic fiber treatment agent according to claim 1, wherein the water is contained in the elastic fiber treatment agent at a content of 0.01% by mass or more and 0.1% by mass or less.

5. The elastic fiber treatment agent according to claim 1, further comprising an allylated polyether, wherein the allylated polyether is contained in the elastic fiber treatment agent at a content of 0.001% by mass or more and 0.2% by mass or less.

6. An elastic fiber to which the elastic fiber treatment agent according to claim 1 is adhered.

* * * * *